US010391507B2

(12) United States Patent
Borinato

(10) Patent No.: US 10,391,507 B2
(45) Date of Patent: Aug. 27, 2019

(54) PORTABLE WASHING DEVICE

(71) Applicant: Positec Power Tools (Suzhou) Co., Ltd, Suzhou (CN)

(72) Inventor: Gianni Borinato, Schio (IT)

(73) Assignee: Positec Power Tools (Suzhou) Co., Ltd, Suzhou (CN)

( * ) Notice: Subject to any disclaimer, the term of this patent is extended or adjusted under 35 U.S.C. 154(b) by 408 days.

(21) Appl. No.: 14/162,234

(22) Filed: Jan. 23, 2014

(65) Prior Publication Data

US 2014/0131475 A1 May 15, 2014

Related U.S. Application Data

(63) Continuation of application No. PCT/CN2012/079181, filed on Jul. 26, 2012.

(30) Foreign Application Priority Data

Jul. 26, 2011 (CN) ..... 2011 1 0209789
Dec. 13, 2011 (CN) ..... 2011 1 0414914

(51) Int. Cl.
*B05B 9/01* (2006.01)
*B08B 3/02* (2006.01)

(52) U.S. Cl.
CPC ..... *B05B 9/01* (2013.01); *B08B 3/026* (2013.01)

(58) Field of Classification Search
CPC ..... B05B 9/01; B05B 9/0861; B08B 3/026
USPC ..... 239/67–70, 74, 331, 332, 526
See application file for complete search history.

(56) References Cited

U.S. PATENT DOCUMENTS

| | | | | | |
|---|---|---|---|---|---|
| 4,801,088 | A | * | 1/1989 | Baker | 239/152 |
| 5,100,058 | A | | 3/1992 | Wei | |
| 5,169,068 | A | | 12/1992 | Bertolini | |
| 5,344,075 | A | | 9/1994 | Springer et al. | |
| 5,381,962 | A | | 1/1995 | Teague | |
| 5,588,303 | A | * | 12/1996 | Parks | B60H 1/3202 239/34 |
| 5,660,334 | A | | 8/1997 | Trusty et al. | |
| 5,669,558 | A | | 9/1997 | Ichel | |
| 5,826,803 | A | * | 10/1998 | Cooper | A62C 31/05 239/556 |
| 5,975,423 | A | | 11/1999 | Rice et al. | |
| 6,189,811 | B1 | | 2/2001 | Rudy | |
| 6,571,151 | B1 | | 5/2003 | Leatherman | |

(Continued)

FOREIGN PATENT DOCUMENTS

| | | |
|---|---|---|
| CN | 2354493 | 12/1999 |
| CN | 2446716 | 9/2001 |

(Continued)

OTHER PUBLICATIONS

International Search Report for PCT/CN2012/079181 dated Nov. 8, 2012.

*Primary Examiner* — Christopher S Kim
(74) *Attorney, Agent, or Firm* — Dentons US LLP

(57) ABSTRACT

A portable washing device, including: a housing, a motor arranged in the housing, a pump driven by the motor, a container for storing washing liquid connected to the pump, a spraying pistol held and controlled by a user connected to the pump, the liquid spraying out from the spraying pistol, the pistol comprises a control unit for controlling the portable washing device.

22 Claims, 6 Drawing Sheets

(56) References Cited

U.S. PATENT DOCUMENTS

| | | | | |
|---|---|---|---|---|
| 6,571,596 | B1 * | 6/2003 | Lindell | B21F 23/00 72/339 |
| 6,572,514 | B1 * | 6/2003 | Calafato | A63B 22/0056 482/79 |
| 6,948,451 | B2 | 9/2005 | Bond et al. | |
| 7,178,740 | B2 | 2/2007 | Williams | |
| 7,182,280 | B2 | 2/2007 | Ye et al. | |
| 7,350,723 | B2 * | 4/2008 | Reedy | 239/332 |
| 2005/0156060 | A1 * | 7/2005 | Attar | 239/332 |
| 2007/0125878 | A1 | 6/2007 | Hahn et al. | |
| 2008/0128032 | A1 | 6/2008 | Lapetina et al. | |
| 2008/0257988 | A1 | 10/2008 | Hahn et al. | |
| 2009/0032618 | A1 * | 2/2009 | Hornsby et al. | 239/333 |

FOREIGN PATENT DOCUMENTS

| | | |
|---|---|---|
| CN | 2469835 | 1/2002 |
| CN | 201231196 | 5/2006 |
| CN | 2820356 | 9/2006 |
| CN | 2936460 | 8/2007 |
| CN | 101108611 | 1/2008 |
| CN | 201123778 | 10/2008 |
| CN | 201182481 | 1/2009 |
| CN | 101422761 | 5/2009 |
| CN | 201286076 | 8/2009 |
| CN | 201558823 | 8/2010 |
| CN | 102015119 | 4/2011 |
| CN | 201841081 | 5/2011 |
| TW | 200835891 | 9/2008 |
| WO | 2008030799 | 3/2008 |

* cited by examiner

PORTABLE WASHING DEVICE

CROSS REFERENCE TO RELATED APPLICATION

This application claims the priority of Chinese Patent Application No. 201110414914.9, filed on Dec. 13, 2011, and Chinese Patent Application No. 201110209789.8, filed on Jul. 26, 2011 in the SIPO (State Intellectual Property of the P.R.C). Further, this application is the continuation of International Application No. PCT/CN2012/079181 filed Jul. 26, 2012.

BACKGROUND OF THE INVENTION

Field of the Invention

The present invention relates to a portable washing device.

Description of Related Art

At present, washing devices have been applied in more and more occasions. In the industrial and agricultural fields, the washing devices are capable of efficiently cleaning the surfaces of objects, but are difficult to carry and store because of large size and heavy weight.

In daily life, small-sized living articles such as doors, windows, cars, etc., need washing manually with tools, like rags, which costs too much labor and achieve poor cleaning results. Usually, cleaners spend a lot of time in cleaning, but the stains attached to the articles still cannot be removed completely, so the efficiency is very low. The large-scale industrial washing devices have some defects and therefore cannot be adapted to household washing. For example, the large-scale washing devices with large power usually generate high water pressure and therefore easliy cause wear or damage the surfaces of small, delicate and exquisite articles during washing. Moreover, those devices are too large and too heavy to move when cleaning doors, windows, etc. Besides, devices for controlling motors and spraying heads are usually installed on the main body of the washing devices, and operators control the motors after putting down the spraying heads, which makes adjustment and control very inconvenient.

At present, the convenient cleaning devices adaptive to household services are not available in the market yet.

SUMMARY OF THE INVENTION

The following presents a simplified summary of the invention in order to provide a basic understanding of some example aspects of invention. This summary is not an extensive overview of the invention. Moreover, this summary in not intended to identify critical elements of the invention nor delineate the scope of the invention. The sole purpose of the summary is to present some concepts of the invention in simplified form as a prelude to the more detailed description that is presented later.

The object of the invention is providing a portable washing device fitting for household service.

According to one aspect, the present invention concerns a portable washing device comprises a housing, a motor arranged in said housing, a pump driven by said motor, a container for storing washing liquid connected to said pump, a spraying pistol grasped and controlled by a user connected to said pump, said liquid spraying out from said pistol, wherein the weight of said portable washing device is no more than 20 kg when said container is empty and the volume of said portable washing device is no more than 40 L.

In a preferred embodiment, the volume of said container is no more than the half of the volume of said portable washing device.

In a preferred embodiment, the volume of said container is no more than 12 L.

In a preferred embodiment, the power of said motor is no more than 800 W.

In a preferred embodiment, the power of said motor is between 500 W and 800 W.

In a preferred embodiment, the pressure of said liquid spraying out from said pistol is between 0 and 80 bar and the time of said liquid continuously spraying out from said pistol is between 5 minutes and 20 minutes.

In a preferred embodiment, the pressure of said liquid spraying out from said pistol is between 0 and 80 bar and the time of said liquid continuously spraying out from said pistol is between 5 minutes and 20 minutes.

In a preferred embodiment, the pressure of said liquid spraying out from said pistol is between 40 and 60 bar and the time of said liquid continuously spraying out from said pistol is between 8 minutes and 15 minutes.

In a preferred embodiment, the weight of said portable washing device is between 5 kg and 15 kg.

In a preferred embodiment, the ratio of the power of said motor to the weight of portable washing device is between 30:1 and 100:1.

In a preferred embodiment, the portable washing device comprises DC power to supply said motor.

In a preferred embodiment, DC power is detachable battery pack.

In a preferred embodiment, the voltage of said battery pack is no more than 36 V.

In a preferred embodiment, the volume of said battery pack is no more than 3 $dm^3$.

In a preferred embodiment, the container has anti-leakage protective unit.

In a preferred embodiment, housing has support unit for supporting said portable washing device.

In a preferred embodiment, the housing having a handle for user's carrying.

In a preferred embodiment, the support unit comprises a first support bar disposed in a horizontal plane at the bottom of said housing, a second support bar connected to said first support bar and disposed vertically relative to said first support bar, a third support bar connected to said second support bar and disposed inclined relative to said second support bar and a guarding plate connected to said third support bar and said first support bar.

Another object of the invention is providing a portable washing device for easy operation.

According to one aspect, the present invention concerns a portable washing device comprises a housing, a motor arranged in said housing, a pump driven by said motor, a container for storing washing liquid connected to said pump, a spraying pistol held and controlled by a user connected to said pump, said liquid spraying out from said pistol, wherein said pistol having control unit to control said portable washing device.

In a preferred embodiment, the pistol having a spraying head where said liquid come out, said control unit controls said spraying area of said spraying head.

In a preferred embodiment, the spraying head having a fixing unit for detachably fixing said spraying head on said pistol.

In a preferred embodiment, the control unit controls the working condition of said motor.

In a preferred embodiment, the control unit is electrically connected to said motor.

In a preferred embodiment, the control unit is wirelessly connected to said motor.

In a preferred embodiment, the controls unit comprises signal generator, said portable washing device comprises signal receiver and control unit, said signal receiver receives the signal from said signal generator and generates a receiving signal to said control unit, said control unit controls the working condition of said motor according to said receiving signal.

In a preferred embodiment, the control signal is electrical signal or magnetic signal or infrared signal.

In a preferred embodiment, the control unit selectively shuts down or turns on said motor.

In a preferred embodiment, the control unit controls the rotation speed of said motor.

In a preferred embodiment, the control unit controls said motor to forward rotate or backward rotate.

In a preferred embodiment, the pistol having a display to show the working condition of said portable washing device.

In a preferred embodiment, the working condition of said portable washing device is the volume or weight of said liquid remaining in said container.

In a preferred embodiment, the working condition of said portable washing device is the pressure of said liquid spraying out from said pistol.

Compared with the prior art, the volume of the container in the portable washing device is quite low, which improves the convenience. And it is easy for operation and adapted to household service.

BRIEF DESCRIPTION OF THE DRAWINGS

The above and other objects, features and advantages of the invention will become more apparent from the following description of embodiments in conjunction with the accompanying drawings in which.

DETAILED DESCRIPTION OF THE INVENTION

Figure 1:
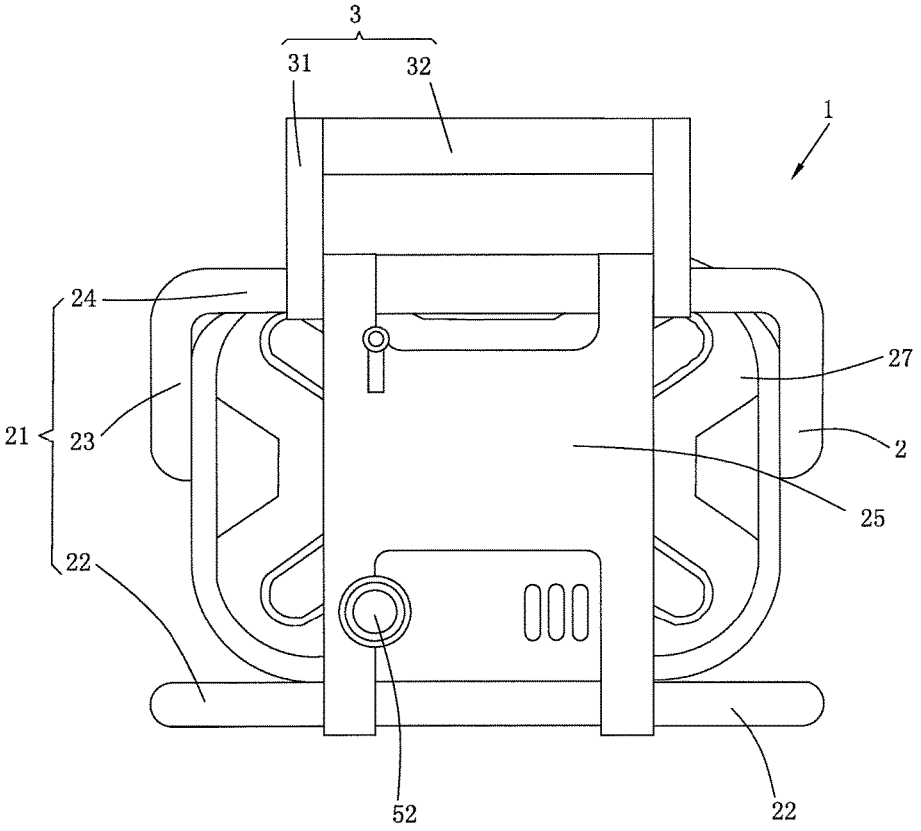
FIG. 1 is a front view of a portable washing device according one embodiment of the present invention.
Figure 2:
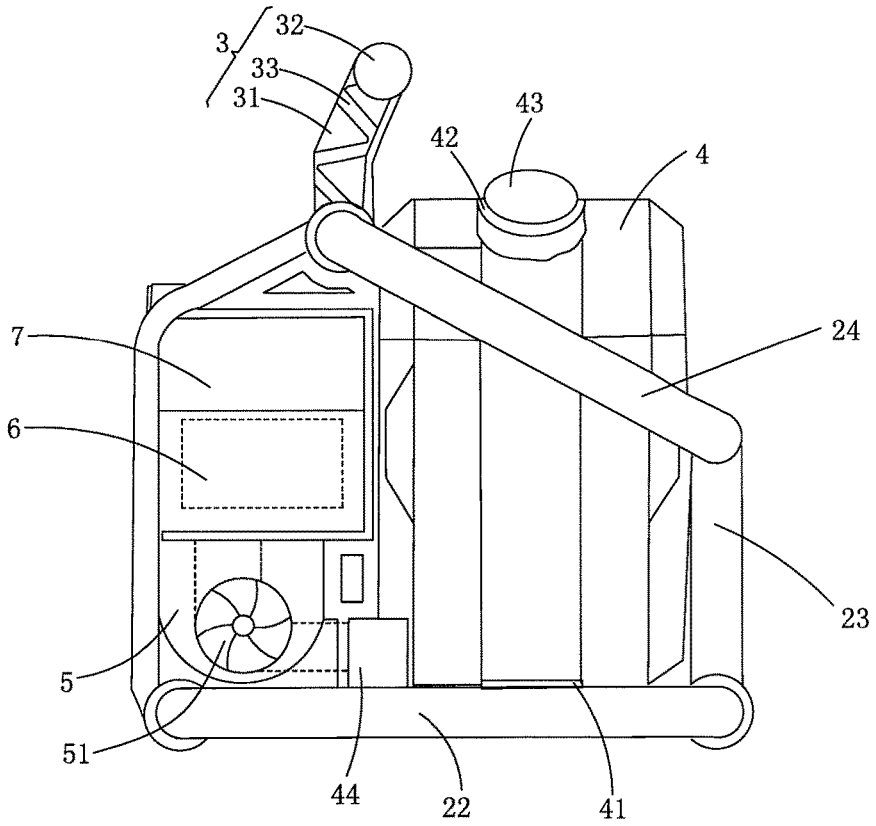
FIG. 2 is a side view of a portable washing device according to FIG. 1.
Figure 3:
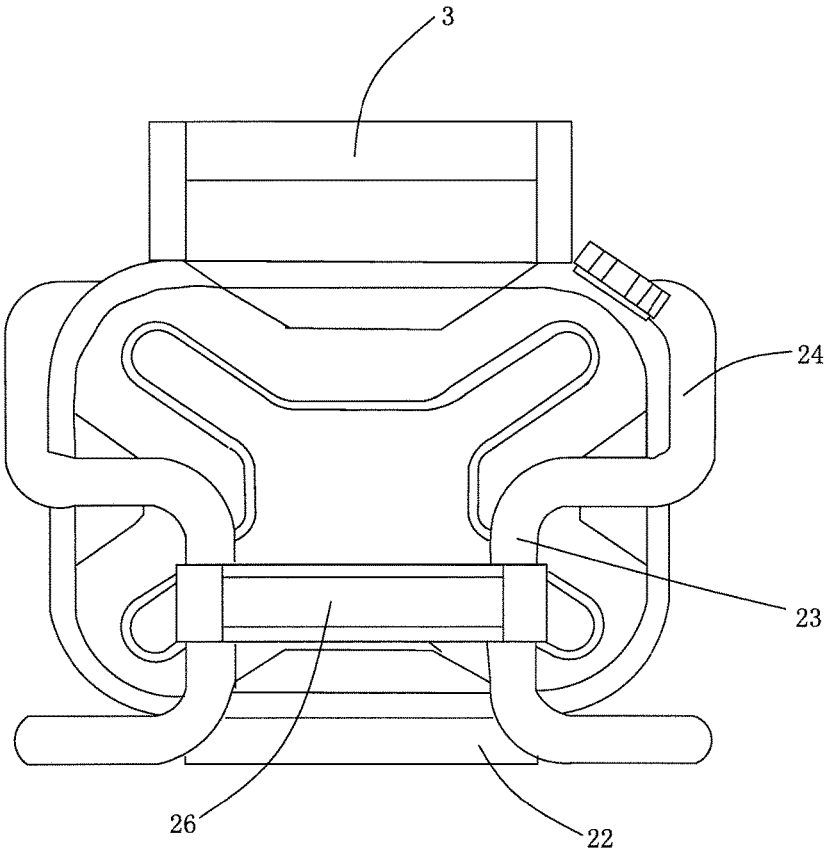
FIG. 3 is a back view of a portable washing device according to FIG. 1.

As shown in FIG. 1 and FIG. 2, one embodiment of the present invention provides a portable washing device 1. The portable washing device 1 mainly has a housing 2, a container 4, a pump 5, a motor 6 and a spraying pistol 9. The housing 2 supporting and protecting the portable washing device 1 has a bottom, sides and a top. The sides include two opposite first sides 27 and two sides 28 respectively adjacent to the first sides 27. In this embodiment, the housing 2 is formed into a frame. As shown in FIG. 1, the housing 2 is comprised of a support frame 21 formed by mutually connecting a series of support bars and forming a support structure that supports the portable washing device. The support structure is comprised of first support bars 22 which are horizontally placed at the bottom of the portable washing device. The first support bars 22 may be placed in parallel, connected end to end to form a closed graph, or formed into two-dimensional grids. Both ends of the first support bars 22 have connectors capable of connecting with other support bars mutually and keeping a certain angle at other support bars. In this embodiment, the first support bars 22 are 37 cm long and are as long as the housing 2. The first support bars 22 support the bottom of the portable washing device 1. In other embodiments, the first support bars 22 may also be provided with cushion plates on which the portable washing device is arranged, which further improves the support force. As shown in FIG. 2 and FIG. 3, the second support bars 23 are vertically placed on the first sides 27 of the portable washing device 1 to provide the portable washing device 1 lateral support force. One end of the first support bar 22 at the bottom is connected with one end of the second support bar 23 at an angle of 90 degrees. In a vertical face, the second support bars 23 are approximately U-shaped. Two second support bars 23 are arranged symmetrically and connected via a connecting bar 26. The connecting bar 26 is located on the first side 27. The other end of the second support bar 23 is connected with one end of a third connecting bar 24. In a vertical face, the third support bar 24 is also approximately U-shaped. The third support bar 24 is connected upward in an inclined way at a certain angle to the vertical face there the second support bar 23 is arranged. More specifically, the third support bar 24 is inclined toward to the inside of the portable washing device 1. From the front view of the second side 27, the angle formed between the third support bar 24 and the second support bar 23 ranges from 110 degrees to 150 degrees.

In a preferable embodiment, the support structure of the portable washing device is also provided with rolling wheels. The portable washing device can be moved to different places through the rolling wheels, which greatly reduces the labor of the operator. The portable washing device is also provided with a pivoting structure rotating with a horizontal axis. In a working condition, rotate the pivoting structure with the axis for extending the portable washing device. And in a spare condition, rotate the pivoting structure with the axis for accommodate the portable washing device in horizontal position which makes the center of gravity of the portable washing device lower and not lean to fall down.

Besides, the third support bar 24 is also provided with a handle 3 comprising a connecting portion 31 and a holding portion 32. The connecting portion 31 is connected with the third support bar 24, and at the joint, the connecting portion 31 is arranged to pivot on the horizontal third support bar 24, as shown in FIG. 2. In the other embodiment, the handle 3 may also be fixed relative to the third support bar 24. Moreover, the handle 3 may also be arranged on the container 4 or the housing of the motor 6. In a preferable embodiment, the handle 3 is in the vertical line with the gravity centre of the portable washing device 1, which makes lifting convenient. The connecting portion 31 of the handle 3 may also be provided with a rib 33. The holding portion 32 is placed in the middle between two connecting portions 31 and fixedly connected with the connecting portions 31. The holding portion 32 has convex and concave surfaces which make holding comfortable. In a preferable embodiment, the holding portion 32 has a granular surface and is made from rubber. The handle 3 including the connection portions 31 and the holding portion 32 is a U-shaped structure, so the operator is capable of conveniently lifting the portable washing device 1. Besides, the housing 2 is also comprised of a guarding plate 25 for protecting the sides of the portable washing device 1. The guarding plate 25 is connected with the third support bar 24 and the first support bars 22 directly and respectively and placed on the first side 27. The guarding plate 25 and the support frame 21 together form the housing 2. The housing 2 has an accommodating space for accommodating the device. In this embodiment, the portable washing device 1 is at most 40 cm long, 40 cm wide and 30 cm high. The volume of the portable washing device 1 is not more than 40 L. In such way, due to the small size, the portable washing device 1 can be conveniently lifted, drawn and dragged by one or more hands of the operator, meets the demands on random movement or convenient storage in household life and is carried conveniently. Besides, the portable washing device can be easily placed in the boot of a car, so people can take the device when traveling. In a preferable embodiment, the housing of the portable washing device is 37 cm long and 26 cm wide, and the volume of the portable washing device 1 is no more than 34 L. In additional, the whole portable washing device 1 is made from a light material and small in size and therefore is no more than 20 kg weight in case of storing no washing liquid. In a preferable embodiment, the weight of the portable washing device 1 ranges from 5 to 15 kg and may be 8 kg, 10 kg, 12 kg, etc.

As shown in FIG. 2, the housing 2 of the portable washing device 1 has a container 4 inside. The container 4 has an accommodating space for storing washing water. Of course, in other embodiments, the washing liquid is not limited to water and may be other liquid for washing. The container 4 is vertically replaced against the second support bar 23. A stopper 41 on the container 4 is matched and fixed with the support bars. The stopper 41 may be a hasp or a lock catch. After the stopper is removed, the water container 4 can be dismantled from the housing 2. The water container 4 may be made of a plastic or flexible material. The container 4 made from the flexible material can be folded. The container 4 has an inlet 42. Usually, the inlet 42 is opened on the top of the container 4, so that water enters the container 4 from the inlet 42 conveniently. The inlet 42 is also provided with a cap 43 which closes the inlet 42 and cuts of communication between the inner part of the container 4 and the outside when no water is required to be injected into the container 4. The cap 43 and the inlet 42 may be in threaded connection. Besides, the inlet 42 may also be connected with one end of a tube, and the other end of the tube is connected to an external water source that may be a tap, a pool or a river. The container 4 also has an outlet 44 that is connected with other elements of the portable washing device 1 for transferring water in the container 4. The outlet 44 is often opened at the bottom of the container 4. The container 4 shall be not higher than the portable washing device 1 and be as high as the third support bar 24. Furthermore, the exterior of the container 4 can be provided with an anti-leakage device for preventing the water in the container 4 from damaging other elements. Considering the portability of the whole device, the volume of the container is no more than half of the whole volume of the portable washing device. In a preferable embodiment, the volume of the container may account for ⅓, ⅖ or other proper proportioning of that of the whole device. In this embodiment, the volume of the container 4 is no more than 20 L and is at most 20 L and at least 8 L. In a preferable embodiment, the volume of the container 4 is no more than 12 L and may be 9 L, 10 L, 11 L or 12 L.

The housing 2 is also provided with a pump 5 inside. The pump 5 is placed nearby the container 4 and connected with the outlet of the container 4, so that the water in the container 4 is capable of entering the pump 5 via the outlet. The pump 5 is used for increasing water pressure to make water spray outside with a certain pressure so as to wash the article surfaces. As shown in FIG. 2, the pump 5 has blades inside that rotate to drive water flow to speed up and therefore generates large pressure. It is worth noting that the washing device provided this invention is orientated toward small articles in daily life, so the washing water with a certain pressure can wash the articles clean and no large-sized pump 5 is required to avoid the device from being importable. Experiments prove that when the pressure provided by the pump 5 ranges from 0 to 8,000,000 Pa, the water can completely clean the surfaces of the small articles for use in daily life, and the device effectively removes stains attached to the surfaces of the small articles and occupies a proper volume. The housing 2 is also provided with a motor 6 inside for providing the pump with power. In this embodiment, the output shaft of the motor 6 is connected with the blade 51 in the pump 5, so that the motor 6 drives the blade 51 to rotate. Of course, the pump 5 may also have other expression methods, e.g.: the pump may comprise a cylinder, a piston or plunger. The power unit such as the motor 6 pushes the piston or the plunger to move axially in the cylinder so as to generate high-pressure washing liquid.

The portable washing device 1 also comprises a DC power supply that supplies the motor 6 with power, wherein the DC power supply comprises a battery pack, a battery, a generator, etc. In this embodiment, the housing 2 of the portable washing device 1 has a detachable battery pack 7 inside. Experiments prove that the rated voltage of the battery pack 7 is not higher than the 36V and is capable of meeting the requirement of providing the motor 6 with power. For people, the safe voltage is 36V, so a rated voltage being not higher than 36V improves safety and prevents risks of electric shocks, etc. In a preferable embodiment, the rated voltage of the battery pack 7 may be 7.2V, 9.6V, 10.8V, 12V, 15V or 18V. Moreover, the battery pack 7 may be a lithium battery or a nickel-cadmium battery, so the volume of the battery pack 7 is small, which makes the whole portable washing device 1 more portable. In this embodiment, the volume of the portable washing device 7 is not more than 3 L. In a preferable embodiment, the volume of the battery pack 7 is not more than 1 L. In this embodiment, the battery pack 7 is fixed on the portable washing device via a fixing member. As shown in FIG. 1, the guarding plate 25 has a charging interface 26 through which an external power supply electrically is capable of being connected with the battery pack 7 for charging. In other embodiments, the battery pack 7 is also provided with a dismantling unit that is connected with the housing 2, so the battery pack 7 can be conveniently dismantled from the device for charging or replacement.

Besides, the portable washing device 1 is also capable of being connected with the external power supply via a power wire, wherein the external power supply may be an on-board power supply or a fixed AC power supply. Generally motor vehicles have smoking lighter. And the portable washing device 1 has a connector combined to the smoking lighter to which is convenient for the portable washing device to get the energy. As it is very hard to find out external power supply in fields, so it is important. And need to point out, the voltage of the connector to smoking lighter is 12V, which is quite nearly to the working voltage of the portable washing device. The low voltage is safe for users and it will not hurt the user.

As shown in FIG. 1, the pump 5 also has an outlet 52. The external device is capable of being connected with the pump 5 via the outlet so as to deliver the water at a certain pressure in the pump 5 to the outside. To avoid the situation that the articles to be washed and the portable washing device 1 cannot work if not being placed close to each other, the device connecting to the outlet 52 may be a tube 8 of a certain length. The tube 8 made from a flexible material is capable of being bent, which makes carrying convenient. The tube 8 is in a spiral configuration and can be circled around when not in use. When it needs to use, users can stretch the tube to connect the spraying pistol 9 and the outlet 52 of the pump 5 in a large distance. The advantage of connecting the tube 8 is that the washing work can be done without moving the portable washing device 1 during washing. One end of the tube 8 is connected with the outlet 52 of the pump 5, while the other end thereof is connected with the spraying pistol 9. The housing 2 of the portable washing device 1 is also provided with an accommodating unit for accommodating the spraying pistol 9. When not required, the spraying pistol 9 is capable of being placed in the accommodating unit to avoid loss and facilitate storage. In one embodiment, the accommodating unit may be an accommodating groove which is similar to the spraying pistol in shape, and the accommodating groove can also be provided with a fastener to avoid the spraying pistol 91 from dropping down. When required to take out the spraying pistol 91, an operator can unfasten the fastener and then take out the spraying pistol 91.

The spraying pistol 9 is also used for spraying water at a certain pressure onto the article surfaces. The spraying pistol 9 comprises a spraying head 91, a main body 92 and a control unit 93. The main body 92 comprises a holding part 95. In this embodiment, the holding part 95 is the handle for holding that is basically gun-shaped, 10 cm long, and suitable for being held by a single hand. Of course, the holding part 95 may also be a D-shaped handle; meanwhile, the gravity centre of the whole spraying pistol 9 is on the holding part 92, so the operator is capable of holding the whole spraying pistol 9 when holding the holding part 95 with a single hand. One end of the main body 92 is connected with the tube 8, while the other end is connected with the spraying head 91. The spraying head 91 has an outlet, and the tube 8 passes through the inside of the spraying pistol 9 and is connected with the outlet of the spraying head 91, so the water is sprayed outside from the spraying head 91 and is capable of being controlled to be sprayed out in different shapes. According to the actual working demands, the water is capable of being sprayed in a mist method or in a converged waterspout method. In addition, the spraying head 91 comprises a fixed member on the spraying pistol 9, so that the spraying head 91 and the spraying pistol 9 are detachably connected, and the spraying pistol 9 is capable of adjusting water spray by externally connecting with different spraying head accessories, for example: the spraying pistol 9 is connected with a shower for showering. Besides, the housing 2 of the portable washing device 1 is provided with a suspension unit. If necessary, the spraying head 91 is suspended on the suspension unit, and then the suspension unit is capable of being lifted higher to further facilitate showering. The suspension unit may be a common annular ring or hook. In other embodiments, the spraying pistol 9 may also be provided with a spraying head for massage that sprays soft and tender water, so that the operator enjoys massage showering. Moreover, the spraying pistol 9 may also be connected with a cone, and the water sprays out from the cone head, so the water speed is faster and the pressure is higher. Of course, the spraying pistol 9 is also capable of being externally connected with a linear bar so that the water spraying from the linear bar is capable of forming a water curtain, or being externally connected with a spraying head of particular shapes, such as flower, peach or hear. The accessories of the spraying head are not limited to the above-mentioned examples.

The main body 92 is provided with the control unit 93 capable of controlling the liquid sprayed from the spraying head 91. The control unit 93 is arranged nearby the holding part 95, so the operator is able to hold the holding part 95 and operate the control unit 93 with one hand at the same time. Therefore, the operator is capable of controlling the liquid just by controlling the control unit 93 on the main body 92 of the spraying pistol 9 and is not required to perform adjustment after putting down the spraying pistol 9, which greatly reduces labor. In a preferable embodiment, the storage chamber for storing washing additives for strengthening the washing effect can be arranged nearby the spraying head 91. During washing, the washing additives are capable of being dissolved into the high-pressure water, so the high-pressure water achieves better washing effect. The main body 92 also comprises a control switch installed on the outer surface of the spraying pistol 9 and directly operated by the operator. The switch control adopts a stepwise adjustment mode, e.g.: the control switch is a toggle button with high, medium and low gears, so that the operator can select corresponding gear according to demands. The control switch may be a button, and pressing the button down means starting. The control switch may be a knob, and the operator rotates the knob to start the device. The control switch may also be in a stepless adjustment mode, e.g.: the control switch is a knob capable of being optionally adjusted at a position a circle or a semi-circle way. The control switch may also be a linkage safety switch to improve operation safety.

Figure 4:
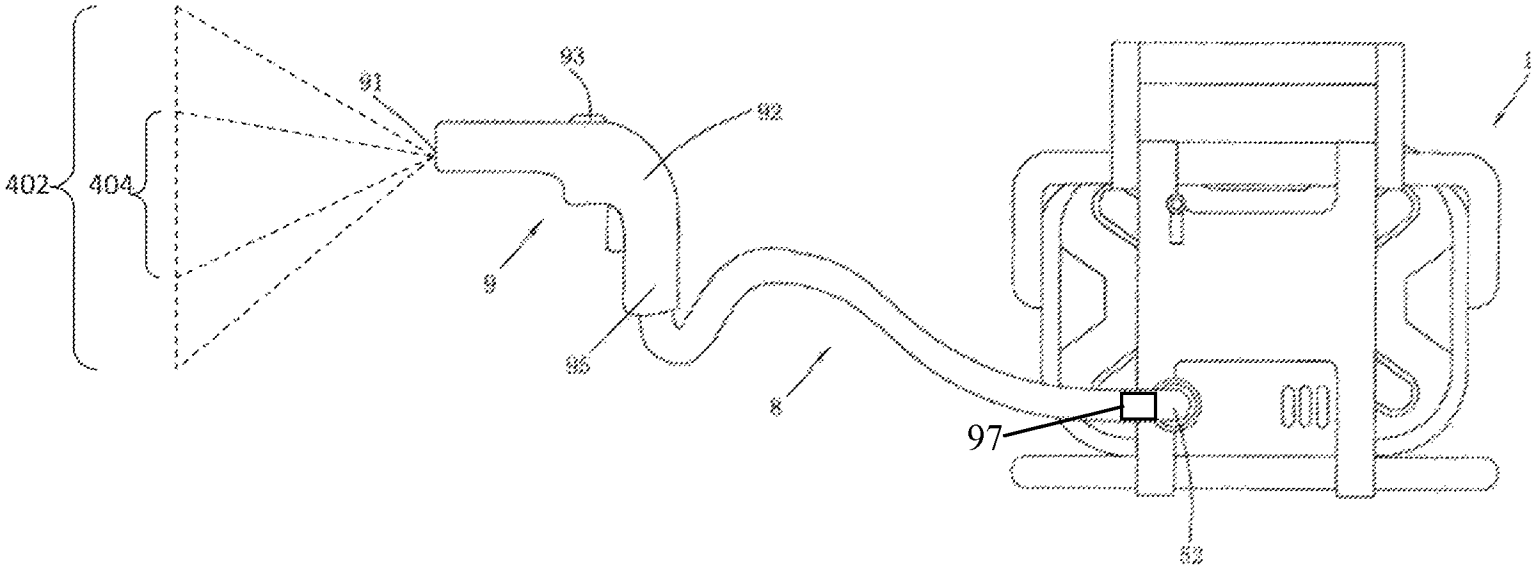
FIG. 4 is a view of a portable washing device connected to a spraying pistol according to FIG. 1.

Also, the control unit 93 has a lot of ways to control the liquid. For example: the control unit 93 is capable of mechanically controlling the spraying head 91, or the control unit can perform control through a worm gear drive or lever drive. In a word, the control unit is able to control the spraying head 91 in the common ways of this field, such as mechanical rotation, linear movement and gear drive. In this embodiment, the control unit is a cam structure rotating around the axis, performing dynamic adjustment by covering the outlet area of the spraying head 91. In other embodiments, the spraying head 91 of the spraying pistol 9 has a plurality of tubes arranged in parallel, and the control unit is capable of selectively opening or closing the plurality of tubes to make one or more outlet spray liquid, which also has the function of adjusting the outlet area of the spraying head 91. The purpose of adjusting the spraying head is to change the flow and pressure of the liquid sprayed from the spraying pistol to adapt to different washing sites. At a site with a large washing area, the operator enlarges the spraying area 402 (as exemplarily and schematically shown at 402 in FIG. 4) of the spraying head by adjusting the control unit 93 conveniently, so that the liquid sprayed from the spraying pistol 9 meets the washing demands. In case of a small washing area, the operator is only required to adjust the control unit 93 to narrow the spraying area (as exemplarily and schematically shown at 404 in FIG. 4) of the spraying head 91. Therefore, the control unit is capable of controlling the flow and pressure of the liquid sprayed from the spout.

In this embodiment, the control unit 93 comprises a control member 610 that controls the motor 6 so that the control unit 93 located on the spraying head 91 controls the motor 6. In such way, the operator's hand is able to control the motor 6 without leaving the spraying pistol 9, which greatly reduces operation. Furthermore, the control member 610 is located on the spraying pistol 9 and keeps a spatial distance away from the motor 6, so the control member 610 is capable of being set into the operating state of electrically connecting with the motor 6 and controlling the motor 6. Of course, the control member 610 and the motor may also be connected in a wireless way.

Figure 5:
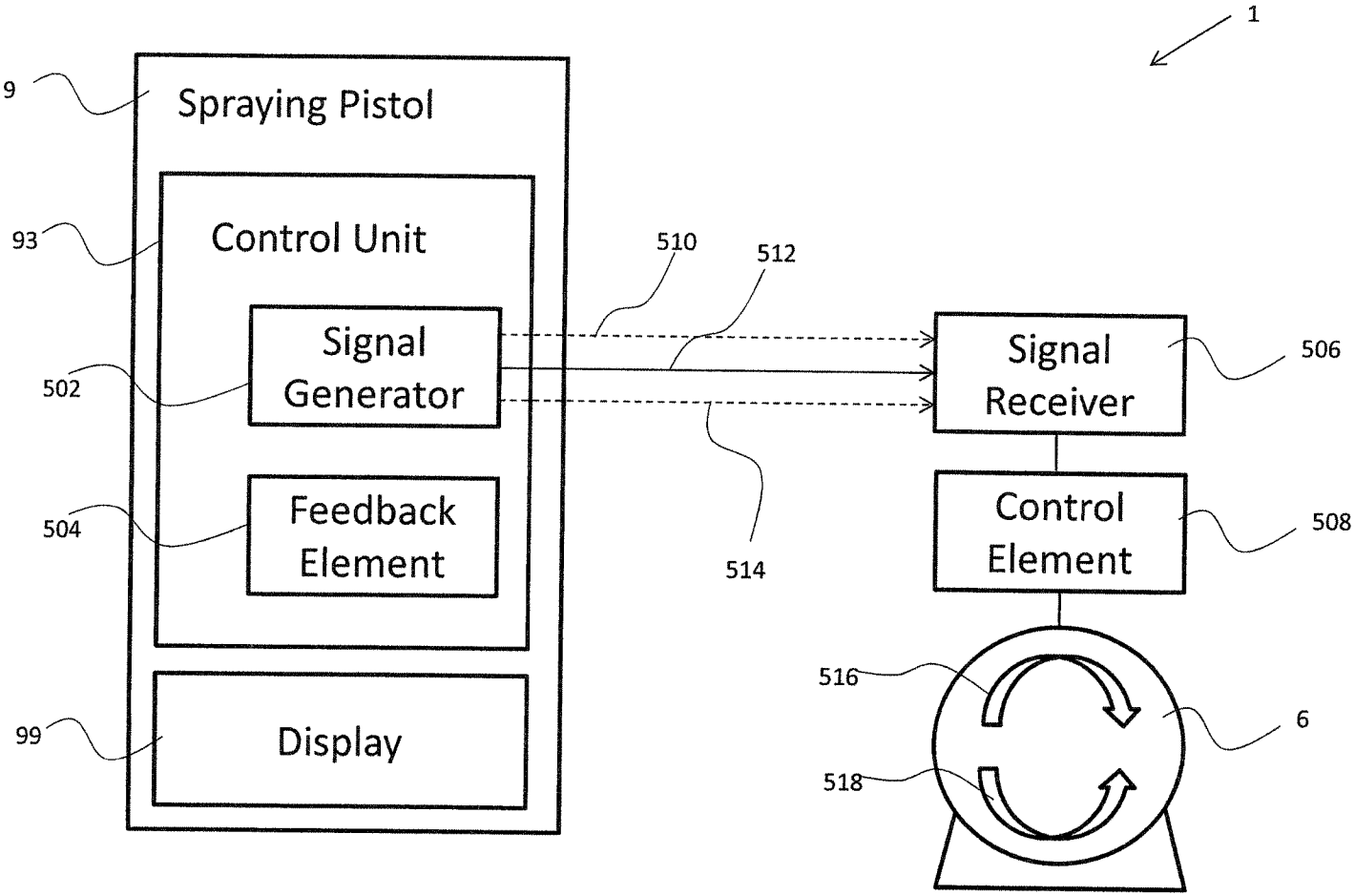
FIG. 5 is a block diagram of a portion of a portable washing device according to FIG. 1.

In one embodiment, the control member 610 and the motor are electrically connected via a wire, e.g., as schematically shown in FIG. 5 at 512. When changing the operating state of the motor 6 is required, the operator operates the control switch to turn on the circuit, so the control member 610 can change the operating state of the motor, wherein changing the motor's operating state may change the operation parameters thereof, such as the power and rotation direction. Besides, the wire is set to be as long as the expanded tube because the spraying pistol and the motor keep a relatively long distance there-between during normal use and the wire shall be of a certain length to avoid being pulled apart. According to experiments, the length of the wire may range from 2 to 5 m. The portable washing device is also provided with a winding unit. When the portable washing device is not used, the wire is capable of being wound on the winding unit to make the whole device neat. The winding unit may be common hooks arranged oppositely or a wire spool. In addition, the wire is capable of being fixedly matched with the tube. For example, the outer surface of the tube is provided with an accommodating groove for accommodating the wire, a wire clip is inserted into the accommodating groove and extends along the tube's extension direction, and a waterproof protection structure is arranged on the periphery of the wire.

In a preferred embodiment, the control unit 93 comprises a feedback element 504 (FIG. 5) between the motor and spraying pistol. The feedback element 504 reflects the change of the motor working condition to the spraying pistol, or reflects the change of the spraying pistol working condition to the motor. The feedback element 504 can constitute in mechanical forms or in electrical forms. When the control unit 93 change the power of the motor, the change is reflected to the spraying pistol through the feedback element 504. The spraying pistol also changes in correspondence with the change of the motor. For example when the power of the motor is turned down, for the sake of maintain the fluid speed of the spraying pistol, the spraying pistol changes the spraying area 402 through the feedback element 504. For same reason, when the spraying pistol 9 changes the fluid speed or spraying area 402, it reflected to the motor 6 correspondently to change the motor work condition such as lowering speed of the motor 6. In other examples, the feedback element 504 can also change the transmission ratio of the gears of the motor 6 instead of not changes the speed of motor directly.

In a preferred embodiment, the control unit 93 has functions to select the washing modes of the spraying pistol 9. In various working environments such as washing the surfaces of the three-dimensional objects, users can select the solid washing mode while washing the plane surfaces of windows or walls, users can select the plane washing mode.

In another embodiment, the control member 610 of the control unit 93 comprises a signal generator 502 (FIG. 5). When a control switch is started, the signal generator 502 sends signals. In addition, the portable washing device 1 is also provided with a signal receiver 506 (FIG. 5) and a control element 508 (FIG. 5). The signal receiver 506 and the signal generator 502 are in wireless connection, e.g., as schematically shown in FIG. 5 at 510 and 514. The signal receiver 506 is used for receiving signals sent from the signal generator 502. The signal receiver 506 is electrically connected with the control member 610 and is capable of generating receiving signals and transmitting the receiving signals to the control member 610. The control member 610 is capable of controlling the motor and outputting instructions to the motor, and the motor changes correspondingly after receiving the instructions, e.g. continuously keeping the original operating state or changing the original operating state. The control member 610 has a CPU, so receiving the receiving signals, the control member 610 processes the signals and makes the CPU output corresponding instructions to the motor, wherein the receiving signals may be square wave signals, sinusoidal wave signals, etc. When the operator starts the control switch, the signal generator 502 on the spraying pistol 9 generates control signals which are transmitted wirelessly and received by the signal receiver 506 on the portable washing device 1, then the signal receiver 506 correspondingly generates and transmits the receiving signals to the control member 610, and the control member 610 receives the receiving signals, processes the signals via processing programs and then outputs instructions to corresponding adjust the operating state of the motor 6, wherein the signals generated by the signal generator 502 may be various radio signals. For example, the signals may be electric signals 512 (as schematically shown in FIG. 5 at 512) or magnetic signals 510 (as schematically shown in FIG. 5 at 510) transmitted via a medium, such as air, and the received by the signal receiver 506; the signals may also be infrared signals 514 (as schematically shown in FIG. 5 at 514), and the corresponding signal receiver 506 is the infrared signal receiver 506; and the transfer and transmission of those signals and instructions are capable of being realized by software programming.

Figure 6:
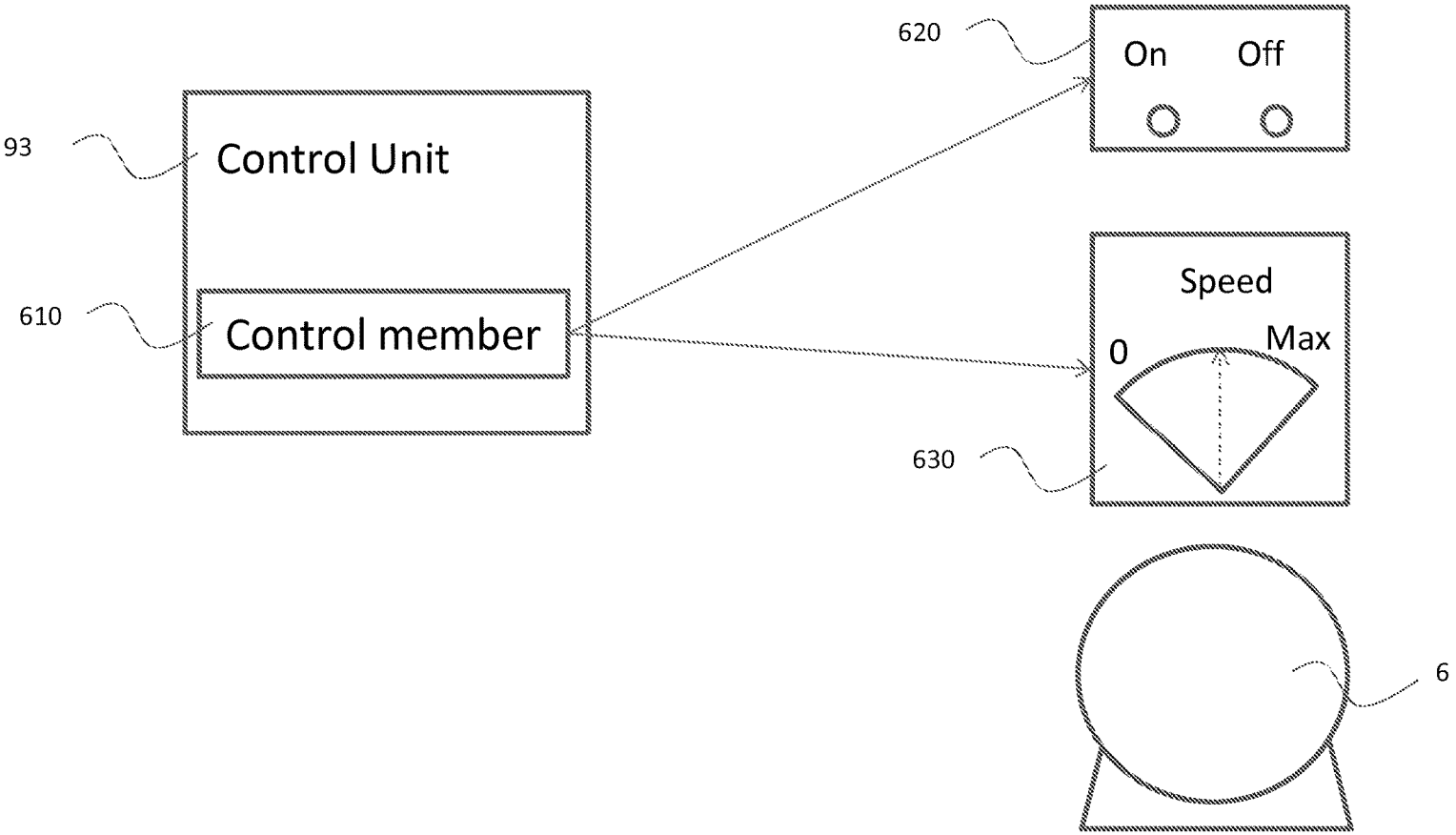
FIG. 6 is a block diagram schematically showing functions of a control member in a portable washing device according to FIG. 1.

The operating state of the motor is specifically comprised of starting, closing, rotation speed, power and rotation direction, etc., so the control member 610 of the control unit 93 is capable of controlling the starting or closing, rotation speed and rotation direction of the motor 6 in the portable washing device 1. For example, as illustrated in FIG. 6, the control member 610 of the control unit 93 is capable of controlling (e.g., at 620) the starting (e.g., On) or closing (e.g., Off), rotation speed (e.g., at 630) and rotation direction (e.g., at 516, 518 described herein with respect to FIG. 5) of the motor 6 in the portable washing device 1.

When the motor 6 rotates forward, for example clockwise as schematically shown at 516 in FIG. 5, the water is capable of being sprayed from the spraying pistol 9 to wash the articles clean; when the motor 6 rotates reversely, for example anti-clockwise as schematically shown at 518 in FIG. 5, the tube 8 connecting with the outlet 52 is separated from the spraying pistol 9 and then directly immersed into the external water source, then the control unit on the spraying pistol 9 controls the motor 6 to rotate reversely to generate negative pressure, and then water enters the container 4 from the tube 8 for later washing. The tube 8 can be also provided with a filter 97 inside so that the impurities in the external water source cannot enter the container 4. In other embodiments, the spraying head 91 of the spraying pistol 9 is also capable of being immersed into the external water source, the control unit on the spraying pistol 9 controls the motor 6 to rotate reversely as schematically shown at 518 in FIG. 5, and then the water finally enters the container 4 from the outlet 52 via the spraying pistol 9 and the tube 8 because the tube 8 is respectively connected with the spraying pistol 9 and the outlet 52. The spraying head 91 of the spraying pistol 9 can also be provided with a filter.

Besides, the spraying pistol 9 is also provided with a display 99 (FIG. 5) for displaying the working state of the portable washing device. Correspondingly, the portable washing device is also provided with a detector inside that is used for detecting the working state thereof, e.g. displaying the volume of the residual liquid in the container, the residual power of the battery pack, the pressure or flow of the water sprayed from the spraying pistol, the working state parameters of the motor, etc. The detector sends detection signals to the display, and the latter displays the detection signals. In a preferable embodiment, the display comprises a screen which the operator touches, which makes the operations of the operator more convenient. Of course, in different embodiments, the display may be arranged on the spraying pistol 9 or on the housing 2.

The basic function of the portable washing device 1 is to provide water with a certain pressure to wash the articles. The water in container 4, or obtained from the outside, is of low pressure and fails to meet requirements, so the pump 5 is required to pressurize the water. At present, some large-scaled washing device usually increase the water pressure at a very high level because people take it for granted that the higher the water pressure is, the better the washing effect is. However, experiments prove that this idea is wrong in the daily life. For example, the surfaces of the articles such as doors, windows and furniture are very dedicated and are easily damaged if washed by high-pressure water. Therefore, the articles for daily use shall be washed at the proper pressure. In a preferable embodiment, the washing effect of the portable washing device 1 is better when the maximal water pressure generated by the pump 5 is no more than 8,000,000 Pa; and the washing effect is best when the water pressure is 5,000,000 Pa. Moreover, if the water pressure is required to be increased to a very high level, the sizes and weights of the corresponding pump 5 and corresponding motor 6 shall be increased, which makes the whole portable washing device 1 importable and fails to meet the demands of daily household use. The pressure shall be proper, and the rated power of the motor 6 shall also be proper, so the size of the motor 6 can be reduced and then that of the whole device is further reduced. In this embodiment, the rated power of the motor 6 is no more than 800 W. In a preferable embodiment, the rated power of the motor 6 ranges from 500-800 W. Therefore, in this embodiment, the ratio of the rated power of the motor to the whole weight of the portable washing device 1 is about 40:1. Of course, in other embodiments, the ratio may also be 50:1, 80:1, etc. In fact, the ratio between 30:1 and 100:1 is acceptable, and the higher ratio meets the portable design of the whole device.

Except for the water pressure, the continuous washing time of the water is one of the factors deciding the washing effect. In case of a short time, the articles usually cannot be washed clean, and in case of a long time, too much water will be costly and a larger container must be required to store water, which makes the whole device larger. The experiments prove that a good washing effect is capable of being achieved when the articles are washed by the water at the pressure of 5,000,000 Pa for about 10 min, meanwhile the volume of consumed water is proper. The water in the container is just enough for washing when the control unit 93 on the spraying pistol 9 controls the water's flow speed to be about 1 L/min. According to actual working conditions, the water's flow speed adjusted by the water control 93 usually ranges from 0.5 L/min to 4 L/min. In such a case, the whole article washing process lasts 5 to 20 min. Preferably, the washing effect is better and the washing time is short when the water's flow speed is adjusted to between 0.8 L/min and 1.2 L/min. Furthermore, the control unit 93 can also drop the water pressure to facilitate washing and prevent the water from splashing on the surfaces of the washed articles, even damaging the surfaces because of over-high pressure.

Calculated by the water's flow speed and the washing time, the volume of the container is no more than 20 L, most preferably no more than 12 L. Such container is capable of just meeting the requirements of the washing device for daily household use and is proper in size.

Besides, to make the pump 5 increase the water pressure to the highest level, the rated power of the motor 6 is set to be 800 W. In a preferable embodiment, the rated power of the motor 6 is set to be 500 W, because the larger the power is, the larger the size. In order to improve the portability, the size of the motor 6 cannot be too large. In addition, the maximal power of the motor 6 ranging from 500 W to 800 W is capable of meeting the requirements.

The present invention is not limited to the above-mentioned embodiments. All structures based on the idea of this prevent belong to the protection range of this invention.

The invention claimed is:

1. A portable washing device, comprising:

a housing;

a motor arranged in the housing;

a pump driven by the motor;

a container connected to the pump and configured to store a washing liquid;

a flexible tube connected to the pump;

a spraying pistol connected to the pump by way of the flexible tube, the spraying pistol being configured to be held and controlled by a user using one hand to spray out the washing liquid from the spraying pistol; and a control unit configured to change one or more of an operating mode or a rotation speed of the motor, wherein the control unit is positioned on the spraying pistol in a location to facilitate simultaneous operation of the control unit and holding of the spraying pistol with the user's one hand.

2. The portable washing device according to claim 1, wherein the spraying pistol comprises a spraying head from which the washing liquid is sprayed out, and the control unit is further configured to control a spraying area of the spraying head based on a user interaction with the control unit.

3. The portable washing device according to claim 2, wherein the spraying head is detachably fixed on the spraying pistol.

4. The portable washing device according to claim 1, wherein the spraying pistol comprises a grip portion configured to be held by the one hand of the user, and the control unit is on a top side of the spraying pistol on a level of the spraying pistol different than the grip portion.

5. The portable washing device according to claim 1, wherein the control unit is electrically connected to the motor.

6. The portable washing device according to claim 1, wherein the control unit is wirelessly connected to the motor.

7. The portable washing device according to claim 1, wherein the control unit comprises a signal generator configured to generate a control signal, the portable washing device further comprises a signal receiver and a control element, the signal receiver is configured to receive the controlling signal from the signal generator and to generate a receiving signal to be communicated to the control element, and the control element is configured to control the rotating speed of the motor when the motor is on based on the receiving signal.

8. The portable washing device according to claim 7, wherein the signal generator is configured to generate a magnetic signal and to transmit the controlling signal to the signal receiver as a magnetic signal.

9. The portable washing device according to claim 7, wherein the signal generator is configured to generate an infrared signal and to transmit the controlling signal to the signal receiver as an infrared signal.

10. The portable washing device according to claim 1, wherein in a first mode, the control unit controls the motor to forward rotate, and in a second mode, the control unit controls the motor to backward rotate.

11. The portable washing device according to claim 10, wherein spraying pistol is configured to be detached from the flexible tube in the second mode, and when the motor is caused to backward rotate by the control unit on the detached spraying pistol, the flexible tube is capable of being submerged in a water supply to fill the container.

12. The portable washing device according to claim 1, wherein the control unit further comprises a feedback element for an interrelationship between the motor and the spraying pistol.

13. The portable washing device according to claim 1, wherein the spraying pistol further comprises a display configured to show a working condition of the portable washing device.

14. The portable washing device according to claim 13, wherein the working condition of the portable washing device is a volume or a weight of the liquid remaining in the container.

15. The portable washing device according to claim 13, wherein the working condition of a portable washing device is the pressure of the liquid spraying out from the spraying pistol.

16. The portable washing device according to claim 1, wherein the weight of the portable washing device is no more than about 20 kg when the container is empty and a volume of the portable washing device is no more than about 40 L.

17. The portable washing device according to claim 1, wherein the volume of the container is no more than half of a volume of the portable washing device.

18. The portable washing device according to claim 1, wherein a power of the motor is no more than about 800 W.

19. The portable washing device according to claim 1, wherein a pressure of the washing liquid spraying out from the spraying pistol is between 0 bar and 80 about bar and a time during which the washing liquid is continuously spraying out from the spraying pistol is between about 5 minutes and about 20 minutes.

20. The portable washing device according to claim 1, wherein the portable washing device further comprises a DC power supply configured to supply power to the motor.

21. The portable washing device according to claim 1, wherein the pump is configured to increase a pressure of the washing liquid.

22. A portable washing device, comprising:

a housing;

a motor arranged in the housing;

a pump driven by the motor;

a container connected to the pump and configured to store a washing liquid;

a flexible tube connected to the pump;

a filter inside the flexible tube; and a spraying pistol connected to the pump by way of the flexible tube, the spraying pistol being configured to be held and controlled by a user and to spray out the washing liquid from the spraying pistol, wherein the spraying pistol comprises a control unit configured to control a rotating speed of the motor.

* * * * *